United States Patent [19]

Vitale

[11] Patent Number: 4,651,370

[45] Date of Patent: Mar. 24, 1987

[54] ONE-PIECE FITTED SHEET AND MATTRESS PAD

[75] Inventor: Joseph Vitale, Charlotte, N.C.

[73] Assignee: Perfect Fit Industries, Inc., Monroe, N.C.

[21] Appl. No.: 719,948

[22] Filed: Apr. 4, 1985

[51] Int. Cl.[4] ..... A47G 9/02

[52] U.S. Cl. ..... 5/497; 5/500; 5/502

[58] Field of Search ..... 5/497, 500, 502, 482, 5/495, 499, 501

[56] References Cited

U.S. PATENT DOCUMENTS

| | | | |
|---|---|---|---|
| 1,533,973 | 4/1925 | Cohen et al. | 5/500 X |
| 1,569,955 | 1/1926 | Falter | 5/500 X |
| 2,856,615 | 10/1958 | Cirocco | 5/500 |
| 3,801,420 | 4/1974 | Anderson | 5/502 X |
| 4,338,693 | 7/1982 | Vitale | 5/497 X |

*Primary Examiner*—Carl D. Friedman
*Assistant Examiner*—R. Chilcot
*Attorney, Agent, or Firm*—Seidel, Gonda, Goldhammer & Abbott

[57] ABSTRACT

A one-piece fitted bed sheet and mattress pad has a batt quilted to a backing fabric and a cover of unquilted sheeting material. The cover is joined to the batt and backing fabric along a seam around their respective perimeters. Elastic tape is provided at preferably opposite ends of the fitted bed sheet and mattress pad to enable it to substantially conform to the shape of the mattress and hold it in place on the mattress.

2 Claims, 8 Drawing Figures

FIG. 3
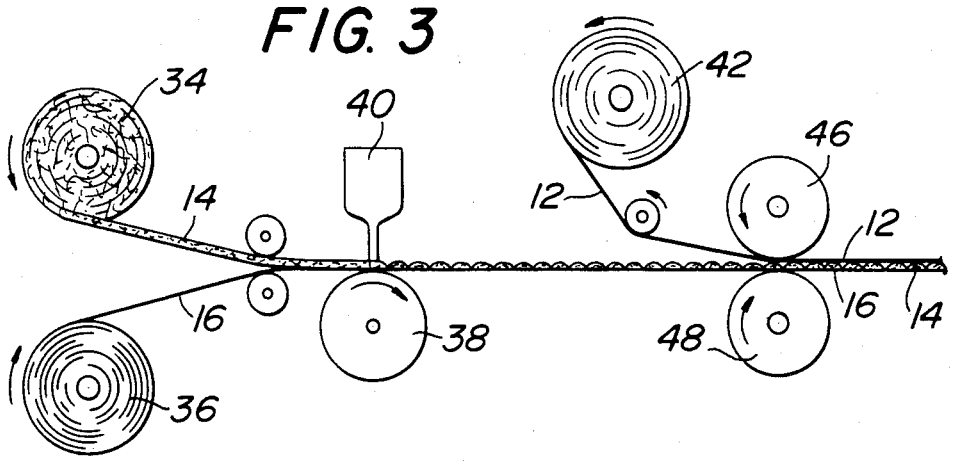
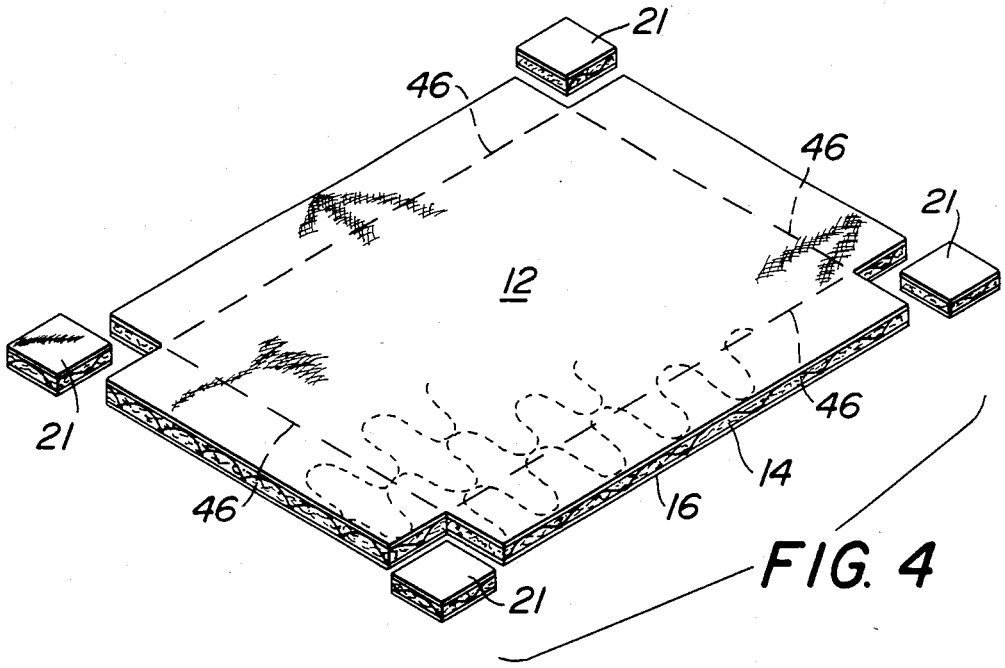
FIG. 4
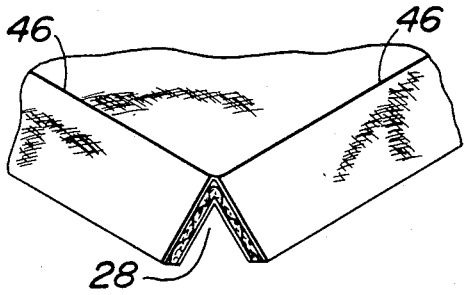
FIG. 5

ONE-PIECE FITTED SHEET AND MATTRESS PAD

BACKGROUND OF THE INVENTION

The invention is a one-piece fitted bed sheet and mattress pad.

In the past, mattress pads and bed sheets have been manufactured and sold as separate items. In a typical prior art mattress pad, the pad is made from a conventional piece of quilted material. That is, a fiberfill batt is quilted to a backing fabric and a top layer. All three pieces, the backing fabric, fiberfill batt and top layer, are joined together at the quilting points. The conventional mattress pad is then placed on a mattress and covered over by a bed sheet.

The prior art mattress pads and bed sheets may be fitted or not. A non-fitted mattress pad is typically simply rectangular in shape and overlies the top of the mattress. The dimensions of the rectangle are typically slightly less than the dimensions of the top of the mattress. A non-fitted sheet is typically simply rectangular in shape, but the dimensions of the rectangle are larger than the dimensions of the top of the mattress to enable the sheet to be wrapped around and tucked under the mattress.

Fitted bed sheets and mattress pads, on the other hand, are typically rectangular but have their corners sewn together to give them more or less the shape of a shallow open box so that they will conform more closely to the top and sides of the mattress. In addition, fitted sheets and mattress pads typically have elastic on opposite ends to enable the fitted sheet or mattress pad to remain in place on the mattress.

There is a need for a one-piece fitted bed sheet and mattress pad. The total amount of material required for a one-piece fitted sheet and mattress pad is substantially the same as that required for a fitted mattress pad alone. This means that a consumer can now have a sheet as well as a mattress pad for about the same price one might pay for a mattress pad alone. In addition, the convenience of handling a one-piece fitted sheet and mattress pad in servicing the bed provides a substantial time saving not only in making up the bed, but in laundering as well.

Other objects and advantages of the invention will appear here and after.

For the purpose of illustrating the invention, there is shown in the drawings a form which is presently preferred; it being understood, however, that this invention is not limited to the precise arrangements and instrumentalities shown.

DESCRIPTION OF THE DRAWINGS

FIGS. 3–8 illustrate intermediate steps in the manufacture of the one-piece fitted bed sheet and mattress pad of the present invention.

SUMMARY OF THE INVENTION

The present invention is a one-piece fitted bed sheet and mattress pad comprising a substantially rectangular backing fabric and a fiberfill batt of substantially the same dimensions as the backing fabric quilted to the backing fabric at one surface of the batt. A cover of unquilted fabric of substantially the same dimensions as the backing fabric and fiberfill batt overlies the fiberfill batt on the surface thereof opposite to the backing fabric. The cover is joined to the backing fabric and fiberfill batt along a seam around their respective perimeters. Elastic means around at least a portion of the seam are provided for enabling the fitted bed sheet and mattress pad to substantially conform to the shape of a mattress and hold the fitted bed sheet and mattress pad in place on the mattress.

The invention also includes a method of manufacturing a one-piece fitted bed sheet and mattress pad, and comprises the steps of quilting a fiberfill batt to a layer of backing fabric at one surface of the batt, placing a layer of unquilted fabric on the batt on the surface of the batt opposite to the backing layer, and joining the backing layer, batt and unquilted fabric together along a seam defining a substantially rectangular perimeter.

DESCRIPTION OF THE INVENTION

Figure 1:
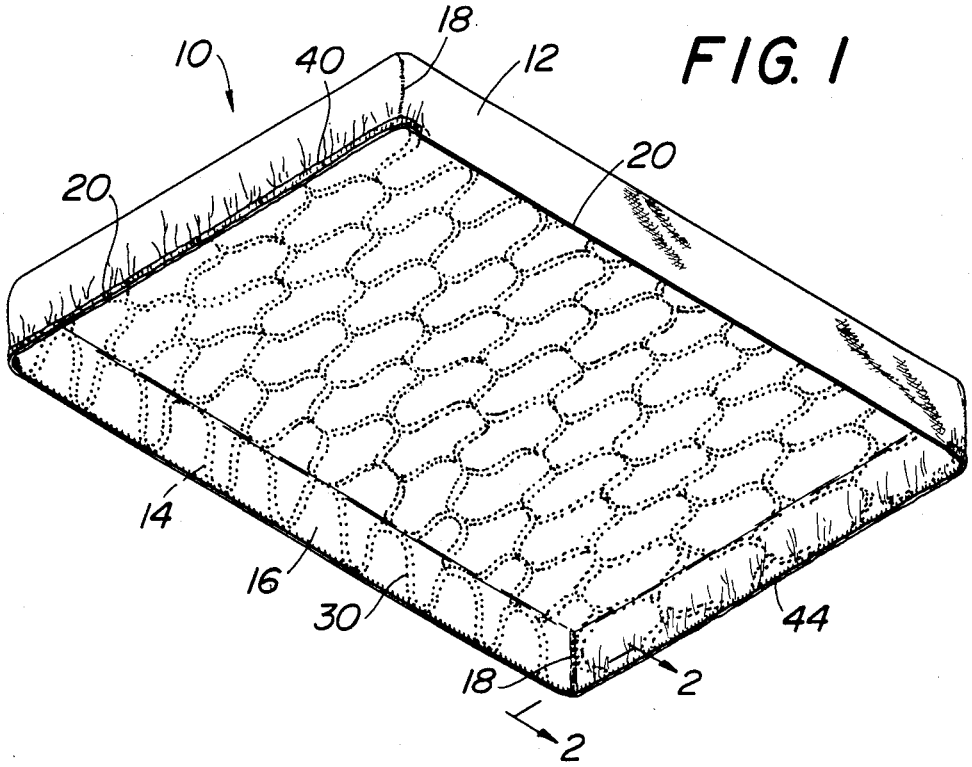
FIG. 1 is a perspective view of the one-piece fitted bed sheet and mattress pad of the present invention from below.

Referring now to the drawings, wherein like numerals indicate like elements, there is shown in FIG. 1 a one-piece fitted sheet and mattress pad 10 in accordance with the present invention. FIG. 1 is a view from below the one-piece fitted sheet and mattress pad so that the underside of the one-piece fitted sheet and mattress pad showing the quilting 30 is clearly visible.

The one-piece fitted sheet and mattress pad comprises a cover 12, a fiberfill batt 14 and a backing fabric 16. Corner seams 18 are provided at the four corners of the one-piece fitted sheet and mattress pad 10 to enable it to more easily conform to the shape of a mattress. Corner seams 18 give onepiece fitted sheet and mattress pad 10 the form of a shallow open box when it is fully extended.

Figure 2:
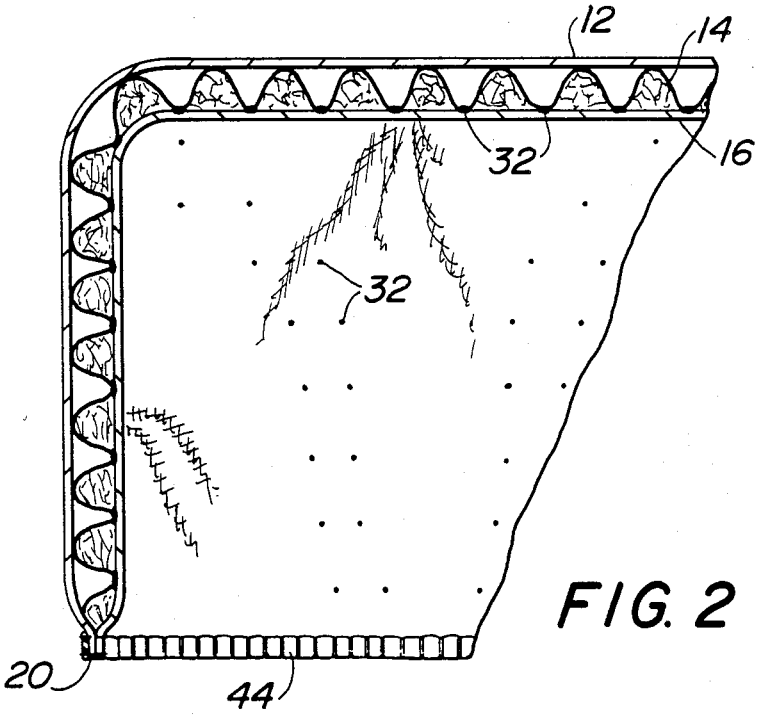
FIG. 2 is a partial sectional view of the one-piece fitted bed sheet and mattress pad taken along the lines 2—2 in FIG. 1.

As best seen in FIG. 2, fiberfill batt 14 is joined to backing fabric 16 along a number of bond points 32 which result from the quilting operation. Batt 14 may be quilted to backing fabric 16 by any known method of quilting. One quilting method which is presently preferred is ultrasonic quilting. Ultrasonic quilting is well-known and understood in the art, and need not be described in detail, except to note here that ultrasonic quilting results in the direct bonding between the fibers of the fiberfill batt 14 and the fibers of the backing fabric 16. In ultrasonic bonding, the fibers of the batt and backing layer are typically thermoplastic. However, fiberfill batt 14 and backing fabric 16 can also be quilted together by needle and thread, for example, without departing from the scope of the present invention.

Cover 12 is preferably a layer of bed sheet material which is placed over the quilted surface of batt 14 and is joined together along a seam 20 around the respective perimeters of cover 12, batt 14 and backing fabric 16. Seam 20 is preferably sewn, although any other suitable method of forming a seam, for example, ultrasonic bonding, may be used without departing from the invention.

In addition to seam 20, corner seams 18 at the four corners of the one-piece fitted sheet and mattress pad 10 are provided to give it a neat, rectangular appearance and fit with a rectangular mattress.

The way in which a one-piece fitted sheet and mattress pad 10 may be manufactured will now be described.

Referring to FIG. 3, the one-piece fitted sheet and mattress pad 10 may be made in the form of a continuous web which can then be severed and sewn as more fully described below. As shown in FIG. 3, backing fabric 16 is supplied from a backing supply roll 36 and fiberfill batt 14 is supplied from a batt supply roll 34. The batt 14 and backing fabric 16 are brought into contact by anvil roll 38 and ultrasonic bonding head 40. Anvil 38 and ultrasonic bonding head 40 are conventional devices used in ultrasonic bonding, and need not be described in detail here. Ultrasonic bonding head 40 and anvil 38 cooperate to ultrasonically quilt batt 14 to backing fabric 16. After the quilting operation, the cover 12 is fed from cover supply roll 42 and brought into contact with the unquilted surface of batt 14. The web may then be passed through a pair of counter-rotating rollers 46 and 48 to ensure intimate contact between cover 12 and batt 14. It should be noted that cover 12 is not bonded in any way to batt 14. It is believed that such a bonding operation is unnecessary for the present invention. However, it should also be noted that cover 12 can be bonded to batt 14 without departing from the scope of the invention.

After the web leaves counter-rotating rollers 46 and 48, it may be cut into substantially rectangular pieces, as shown in FIG. 4. The dimensions of the rectangle are chosen so that the finished one-piece fitted sheet and mattress pad will conform to standard mattress dimensions (i.e., twin, full, queen size or king size). The size of the rectangle may also be chosen to accommodate custom mattresses of non-standard size.

As best seen in FIG. 4, the corners 21 of the rectangle are cut away so that the one-piece fitted sheet and mattress pad 10 may be folded along the dashed lines 46. As best seen in FIG. 5, after the material is folded along dashed lines 46, it is brought together at join lines 28, and corner seam 18 is sewn in along join lines 28. As noted above, corner seams 18 enable the one-piece fitted sheet and mattress pad to assume a neat shape and better conform to the rectangular shape of a mattress.

As a final operation, elastic strips 44 are sewn along seam 20, preferably at opposite ends of the one-piece fitted sheet and mattress pad 10. However, elastic 44 may be sewn in at only the corners, or around the entire perimeter of seam 20, without departing from the invention.

Figure 6:
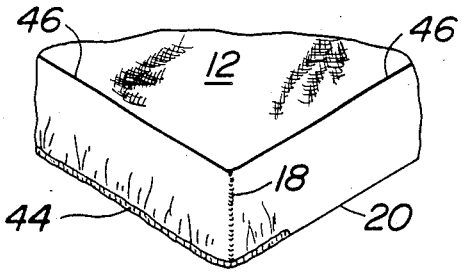
Figure 7:
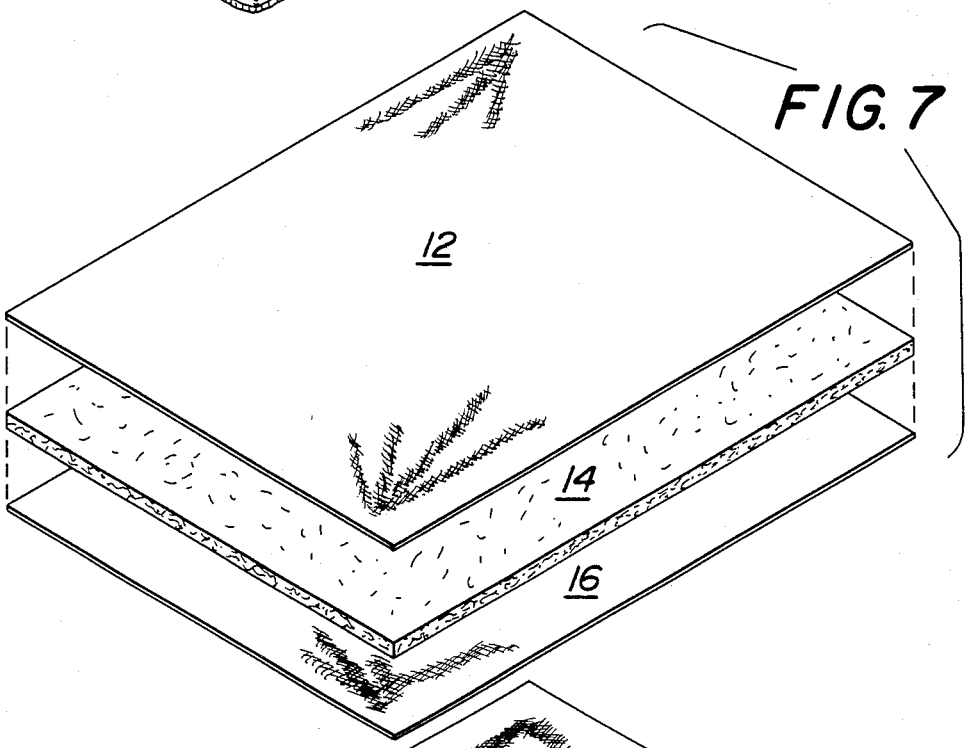
Figure 8:
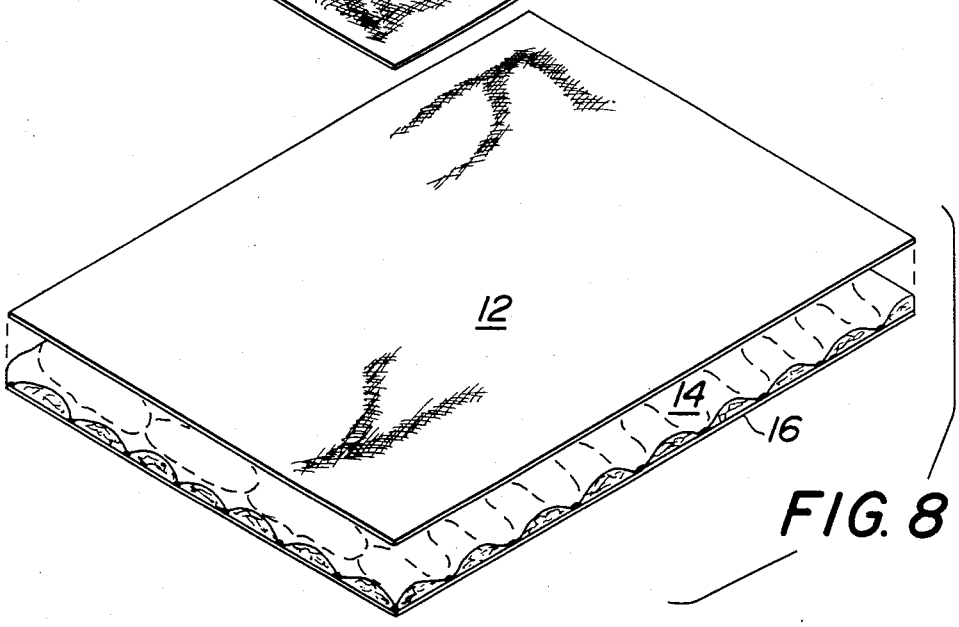

Although the manufacturing method described above is presently the preferred method, the one-piece fitted sheet and mattress pad can be manufactured in other ways. For example, referring to FIG. 7, cover 12, batt 14 and fabric 16 may be cut into individual rectangles prior to quilting batt 14 to backing fabric 16. The result of the quilting operation is shown in FIG. 8. After batt 14 has been quilted to backing fabric 16, cover 12 is placed on batt 14, corners 21 are cut away, and the one-piece fitted sheet and mattress pad is finished as described above in connection with FIGS. 4–6.

The present invention may be embodied in other specific forms without departing from the spirit or essential attributes thereof and, accordingly, reference should be made to the appended claims, rather than to the foregoing specification, as indicating the scope of the invention.

I claim:

1. A one-piece fitted bed sheet and mattress pad comprising first and second layers having a substantially rectangular fiberfill batt therebetween, the first layer having substantially the same dimensions as the batt and being quilted to the batt at one surface of the batt, the second layer having substantially the same dimensions as the batt and the first layer and being in direct contact with the opposite surface of the batt but unquilted to the batt, the second layer being joined to the batt and first layer only along a seam around their respective perimeters, and including elastic means around at least a portion of the seam for enabling the bed sheet and mattress pad to substantially conform to the shape of a mattress and hold the bed sheet and mattress pad in place on the mattress.

2. A one-piece fitted bed sheet and mattress pad according to claim 1 wherein the backing fabric and batt are comprised of thermoplastic fibers.

* * * * *